US005463536A

United States Patent [19]

Chou et al.

[11] Patent Number: 5,463,536

[45] Date of Patent: Oct. 31, 1995

[54] UMBRELLA WITH A LIGHT SOURCE AND LIGHT REFRACTING MEANS

[76] Inventors: Luk Chou, No. 1, Alley 9, Lane 250, Sec 2, Cheng Gung Rd., Nei Hu Area, Taipei; Jonathan Cheng, 5F., No. 10, Lane 169, Sec 1, Ta-an Rd., Taipei; Chin I. Lin, No. 23, Jui Yuan Area, Ta Hsi City Taoyuan Hsien, all of Taiwan

[21] Appl. No.: 396,437

[22] Filed: Feb. 28, 1995

[51] Int. Cl.[6] ..... A45B 3/02

[52] U.S. Cl. ..... 362/102; 362/32

[58] Field of Search ..... 362/102, 32, 308, 362/399, 253; 135/16

[56] References Cited

U.S. PATENT DOCUMENTS 2,372,471 3/1945 Campbell ..... 362/102 X 5,126,922 6/1992 Andreasen ..... 362/102 X

*Primary Examiner*—Stephen F. Husar

*Attorney, Agent, or Firm*—Bacon & Thomas

[57] ABSTRACT

An umbrella having a light source mounted inside the umbrella handle and controlled by a slide switch to give off light through a refractor around the umbrella shaft, wherein the umbrella shaft is a transparent, solid, polygonal rod having a refracting area for refracting the light of the light source toward the ribs and umbrella cover of the umbrella.

7 Claims, 4 Drawing Sheets

UMBRELLA WITH A LIGHT SOURCE AND LIGHT REFRACTING MEANS

BACKGROUND OF THE INVENTION

The present invention relates to umbrellas, and relates more particularly to such an umbrella which has a light source mounted inside the handle and controlled to illuminate the umbrella when the umbrella is opened.

Various umbrellas are developed having light source means for illumination. Among these umbrellas, there is one having the light source means mounted on the finished cap at the top end of the umbrella shaft and controlled to give off light by a switch on the umbrella handle, another one having the light source means mounted on the umbrella handle and controlled to give off light by a switch on the umbrella handle, still another one having the light source means mounted on the tips at the ends of the ribs of the umbrella frame assembly. These arrangements can only illuminate a limited area that is insufficient to give a warning signal to passers-by or vehicle drivers. Furthermore, if the light source means is mounted on the tips at the ends of the ribs of the umbrella frame assembly, the electric wiring is difficult to install.

There is known another structure of umbrella in which a plurality of light emitting elements and light diffusers are mounted within the umbrella cover among the ribs and controlled to illuminate the umbrella cover when the umbrella is opened. This illuminating arrangement is complicated and it greatly increases the cost of the umbrella. Furthermore, because this illuminating arrangement uses a plurality of light emitting elements, it consumes much power supply during the operation.

SUMMARY OF THE INVENTION

The present invention has been accomplished to provide an umbrella with a light source and light refracting means which eliminates the aforesaid drawbacks. According to one embodiment of the present invention, a light source is mounted inside the umbrella handle and controlled by a slide switch to give off light through a refractor around the umbrella shaft, wherein the umbrella shaft is a transparent, solid, polygonal rod having a refracting area for refracting the light of the light source toward the ribs and umbrella cover of the umbrella.

BRIEF DESCRIPTION OF THE DRAWINGS

FIG. 3 is a partial view of FIG. 2, showing the movable contact metal plate moved by the slide and connected to the light source and the light source turned on;

DETAILED DESCRIPTION OF THE PREFERRED EMBODIMENT

Figure 1:
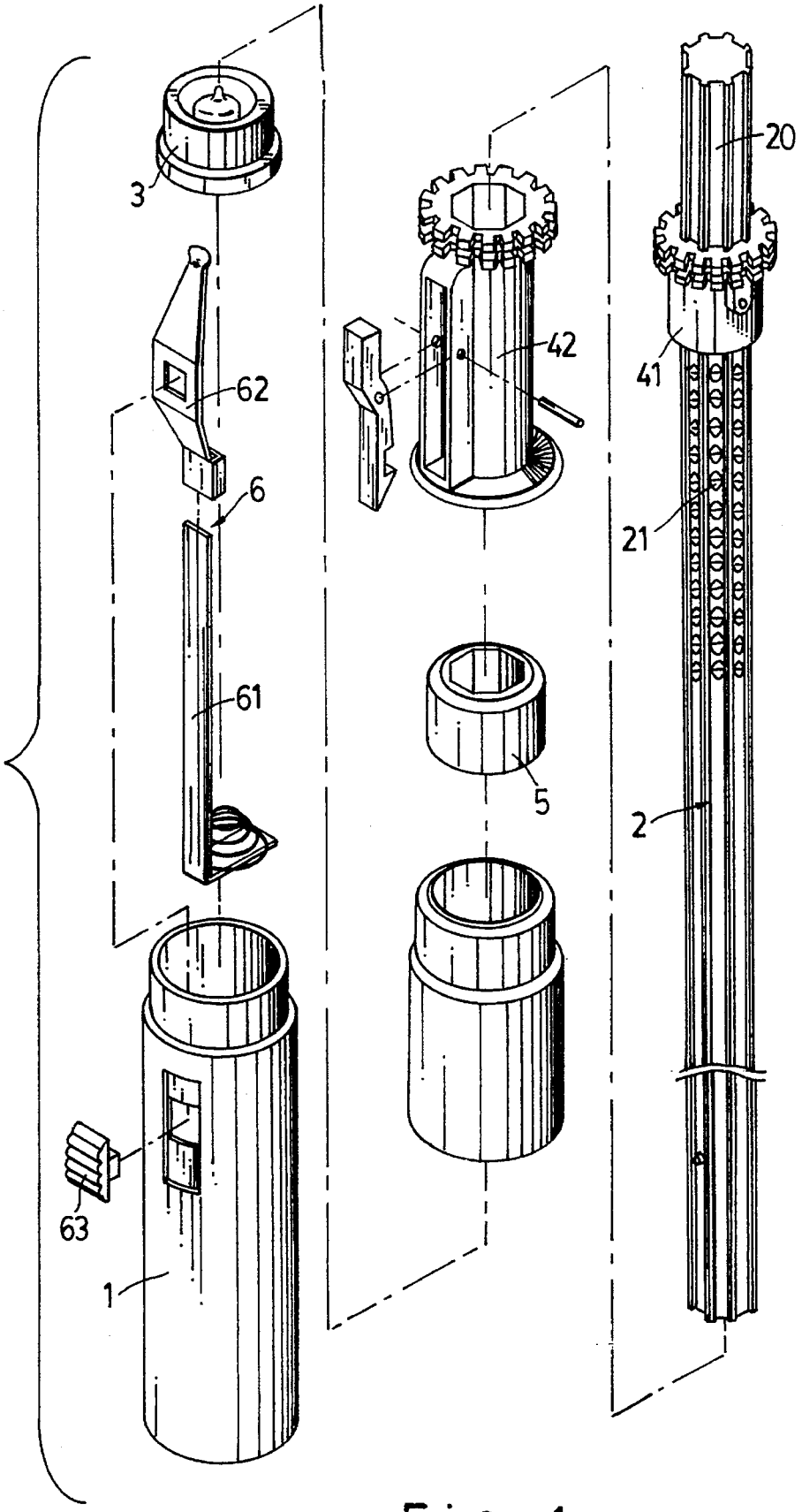
FIG. 1 is an exploded view of an umbrella frame assembly for an umbrella according to the present invention.
Figure 2:
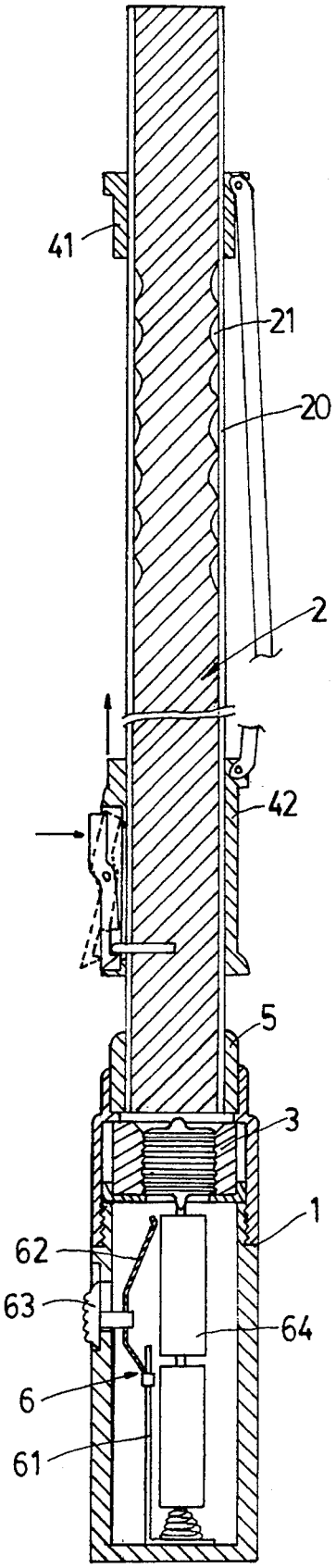
FIG. 2 is a longitudinal assembly view in section of the umbrella frame assembly shown in FIG. 1.
Figure 3:
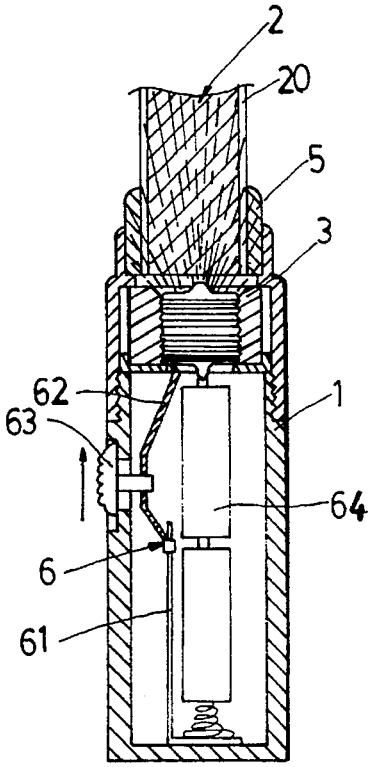
Figure 5:
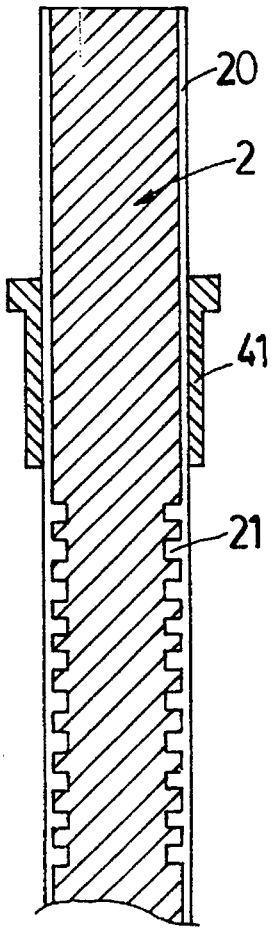
FIG. 5 shows an alternate form of the refracting area of the shaft according to the present invention.
Figure 6:
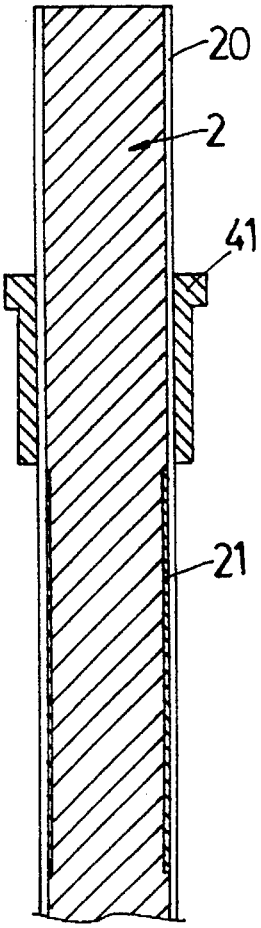
FIG. 6 shows another alternate form of the refracting area of the shaft according to the present invention.
Figure 7:
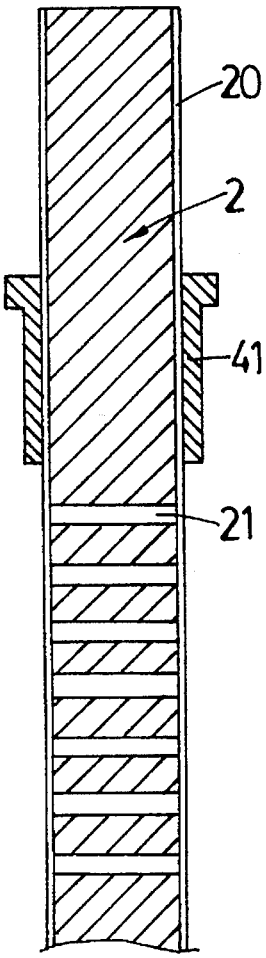
FIG. 7 shows still another alternate form of the refracting area of the shaft according to the present invention.

Referring to FIGS. 1, 2, and 3, an umbrella frame assembly in accordance with the present invention is generally comprised of a handle 1, a shaft 2, a light source 3, a fixed ring 41, a runner 42, a refractor 5, a power control unit 6, and other accessories including ribs and stretchers. The light source 3, which can be a lamp bulb, and the power control unit 6 are mounted within the handle 1. The power control unit 6 comprises a battery set 61, a fixed contact metal plate 61 connected to one end of the battery set 61, a movable contact metal plate 62 coupled to the fixed contact metal plate 61 by a loose joint, and a slide 63 disposed outside the handle 1 and moved to control the connection of the movable contact metal plate 61 to the light source 3. When the movable contact metal plate 62 touches the light source 3, as shown in FIG. 3, the battery set 64 is electrically connected to the light source 3, causing the light source 3 to give off light. The refractor 5 is mounted on the outside of the shaft 2 around the light source 3 to refract the light of the light source 3. The shaft 2 is a transparent, solid, polygonal rod having a plurality of longitudinal grooves 20 around the periphery, which improves the light refracting power of the shaft 2. The shaft 2 further comprises a refracting area 21 near the fixed ring 41. The refracting area 21 may be variously embodied. For example, the refracting area 21 can be comprised of raised portions and recessed portions alternatively arranged at different elevations as shown in FIG. 5. The refracting area 21 can also be made corrugated as shown in FIG. 2, serrated, frosted as shown in FIG. 6, or perforated as shown in FIG. 7.

Figure 4:
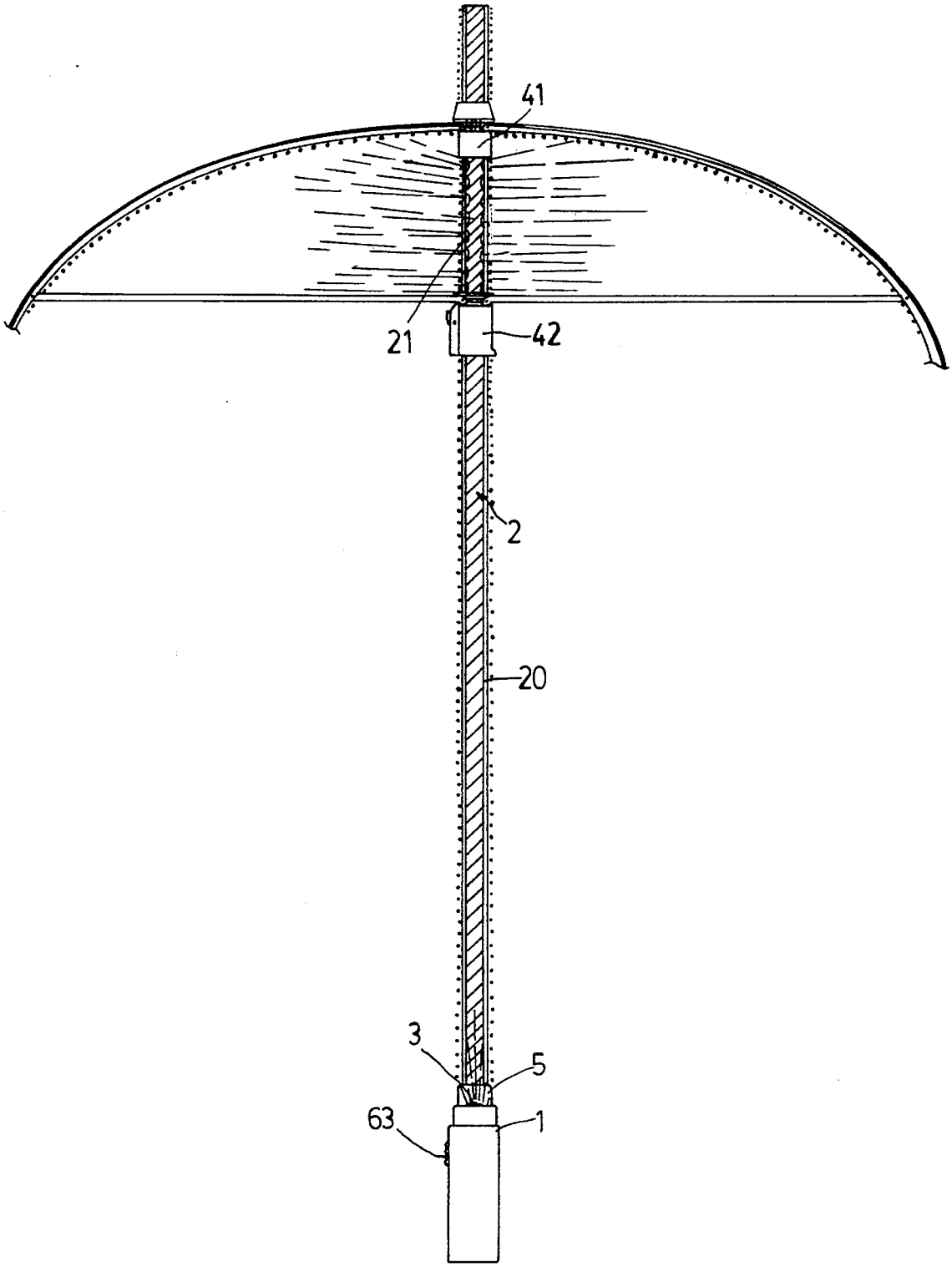
FIG. 4 shows the umbrella opened and the whole body of the umbrella illuminated according to the present invention.

Referring to FIG. 4, when the umbrella is opened and the light source 3 is turned by means of the control of the slide 63, the refractor 5 refracts the light of the light source 3 in all directions, and the light of the light source 3 is simultaneously transmitted through the shaft 2 and refracted by the refracting area 21 of the shaft 2 to the ribs, stretchers and umbrella cover of the umbrella, and therefore the whole umbrella body is illuminated.

What is claimed is:

1. An umbrella comprising a shaft, a handle securely fixed to one end of said shaft, a fixed ring and a runner respectively mounted around said shaft, a plurality of ribs respectively hinged to said fixed ring, an umbrella cover stretched over said ribs, a plurality of stretchers respectively hinged between said runner and said ribs, a power control unit mounted on said handle, and a light source mounted inside said handle and controlled to give off light, wherein a refractor is mounted on said shaft around said light source to refract the light of said light source out of said handle; said shaft is a transparent, solid, polygonal rod having a refracting area adjacent to said fixed ring for refracting the light of said light source toward the ribs and umbrella cover of the umbrella.

2. The umbrella of claim 1 wherein said refracting area of said shaft is comprised of raised portions and recessed portions alternatively arranged at different elevations.

3. The umbrella of claim 1 wherein said refracting area of said shaft is made corrugated.

4. The umbrella of claim 1 wherein said refracting area of said shaft is made serrated.

5. The umbrella of claim 1 wherein said refracting area of said shaft is made frosted.

6. The umbrella of claim 1 wherein said refracting area of said shaft is made perforated.

7. The umbrella of claim 1 wherein said shaft has a plurality of longitudinal grooves around the periphery.

* * * * *